US006543621B2

(12) United States Patent
Baltzer et al.

(10) Patent No.: US 6,543,621 B2
(45) Date of Patent: Apr. 8, 2003

(54) INTEGRATED GASKET AND SCREEN FRAME

(75) Inventors: Terry L. Baltzer, Talala, OK (US); Russell Allen Riddle, Chelsea, OK (US)

(73) Assignee: Southwestern Wire Cloth, Inc., Tulsa, OK (US)

( * ) Notice: Subject to any disclaimer, the term of this patent is extended or adjusted under 35 U.S.C. 154(b) by 0 days.

(21) Appl. No.: 09/931,132

(22) Filed: Aug. 16, 2001

(65) Prior Publication Data

US 2003/0034279 A1 Feb. 20, 2003

(51) Int. Cl.[7] ..... B07B 1/46; B07B 1/28

(52) U.S. Cl. ..... 209/405; 209/269; 209/372; 209/408

(58) Field of Search ..... 209/405, 408, 209/411, 209, 372

(56) References Cited

U.S. PATENT DOCUMENTS

| | | | | | |
|---|---|---|---|---|---|
| 2,314,878 | A | * | 3/1943 | Heller | 209/405 |
| 3,022,893 | A | * | 2/1962 | Hasley | 209/405 |
| 3,029,946 | A | * | 4/1962 | Wright, Jr. et al. | 209/408 |
| 3,035,700 | A | * | 5/1962 | Cuasland | 209/405 |
| 3,169,475 | A | * | 2/1965 | Caquette | 209/405 |
| 3,463,315 | A | * | 8/1969 | Reisbeck et al. | 209/401 |
| 3,928,189 | A | * | 12/1975 | Lower et al. | 209/403 |
| 4,137,157 | A | * | 1/1979 | Deister et al. | 209/403 |
| 4,861,462 | A | * | 8/1989 | Lehmann et al. | 209/269 |
| 5,271,504 | A | * | 12/1993 | Bowen et al. | 209/316 |
| 5,372,261 | A | * | 12/1994 | Galton et al. | 209/399 |
| 5,456,365 | A | * | 10/1995 | Janssens et al. | 209/403 |
| 5,584,143 | A | * | 12/1996 | Kennedy | 49/501 |
| 5,690,826 | A | * | 11/1997 | Cravello | 210/384 |
| 5,829,599 | A | * | 11/1998 | Woodgate | 209/399 |
| 5,927,511 | A | | 7/1999 | Riddle et al. | 209/405 |
| 5,927,513 | A | * | 7/1999 | Hart | 209/677 |
| 5,944,197 | A | | 8/1999 | Baltzer et al. | 209/400 |
| 5,947,320 | A | * | 9/1999 | Bordner et al. | 220/321 |
| 5,967,336 | A | | 10/1999 | Baltzer et al. | 209/403 |
| 6,096,210 | A | * | 8/2000 | Hazrati et al. | 210/388 |
| 6,099,612 | A | * | 8/2000 | Bartos | 55/481 |
| 6,260,711 | B1 | * | 7/2001 | Woodgate | 209/405 |
| 6,269,954 | B1 | * | 8/2001 | Baltzer | 209/405 |
| 6,349,631 | B2 | * | 2/2002 | Joergensen | 99/313 |
| 6,371,301 | B1 | * | 4/2002 | Shulte et al. | 209/405 |
| 6,378,267 | B1 | * | 4/2002 | Bass | 52/656.7 |
| 6,439,392 | B1 | * | 8/2002 | Baltzer | 209/405 |

FOREIGN PATENT DOCUMENTS

| | | | | |
|---|---|---|---|---|
| GB | 2059807 | * | 4/1981 | 209/405 |

* cited by examiner

*Primary Examiner*—Donald P. Walsh
*Assistant Examiner*—Daniel K Schlak
(74) *Attorney, Agent, or Firm*—Head, Johnson & Kachigian

(57) ABSTRACT

An integrated gasket and screen frame for a screen assembly for use with a vibrating shaker. The screen assembly includes a tubular frame having a top side and an under side. At least one screen cloth is affixed to the top side of the frame. A slot in the tubular frame has a width. An elastomeric gasket has at least a portion wider than the width of the slot so that the gasket may be press fit and mechanically locked into the slot and held therein.

21 Claims, 5 Drawing Sheets

INTEGRATED GASKET AND SCREEN FRAME

BACKGROUND OF THE INVENTION

1. Field of the Invention

The present invention is directed to a screen assembly for a vibrating shaker having an integrated gasket and screen frame. In particular, the present invention is directed to a screen assembly for a vibrating shaker wherein the gasket is mechanically locked to the screen frame without use of any adhesives or fasteners.

2. Prior Art

Various types of vibrating screen machines have been utilized in the past for screening and separation purposes. In one known arrangement, a screen or screen assembly is detachably secured to the vibrating shaker machine. The screen assembly is vibrated at a high frequency or oscillation by a motor or motors for the purpose of screening or separating materials placed on the top of the screen assembly and fed thereover. Liquid and fine particles will pass through the screen assembly by force of gravity and be recovered underneath. Solid particles above a certain size migrate and vibrate across the screen or screens where they are removed.

In some vibrating shakers, a bed or deck is composed of a plurality of parallel, cushioned rails on which the screen assembly or screen assemblies rest.

In other vibrating shaker designs, the bed or deck is not cushioned. In these instances, the screen assembly or screen assemblies themselves must have a gasket on the lower side. The gasket not only acts as a cushion but provides a liquid tight seal between the screen assembly and the vibrating shaker.

In the past, a neoprene or other material would be adhesively applied on the underside of the steel frame of the screen assembly. An adhesive such as methyl methacrylate might be used. The steel frame must be extremely clean or the adhesive will not work properly. Accordingly, a separate step of cleaning the frame is often required. Additionally, the adhesive itself could be subject to failure if the proper amount of adhesive is not applied. Moreover, the screen assemblies are subjected to corrosive materials at high temperatures. Adhesives must be selected for the conditions being encountered. Corrosion of the gasket is possible depending on the materials being screened and the conditions encountered.

Accordingly, it is a principal object and purpose of the present invention to provide a screen assembly having an integrated gasket with a mechanical lock which will not require any adhesives or fasteners.

It is a further object and purpose of the present invention to provide an integrated gasket and screen assembly wherein the gasket may be press fit into the frame of the screen assembly.

It is a further object and purpose of the present invention to provide an integrated elastomeric gasket and screen assembly where the gasket is both compressible and resilient.

SUMMARY OF THE INVENTION

The present invention is directed to an integrated gasket and screen frame for a screen assembly used on a vibrating shaker. The screen frame includes a pair of parallel opposed sides and a pair of parallel opposed ends. All of the sides and all of the ends may be composed of the same pieces which are extruded and then cut to the desired size. The frame includes an underside and an opposed, top side. The top side of the frame has a flat, planar surface. A perforated plate may be attached to and secured to the frame. The perforated plate includes a plurality of openings and may include a border area which will align with the planar surfaces of the top side of the frame, providing an area for good adhesion between the frame and the plate.

At least one screen cloth is secured to the perforated plate.

The frame also includes a plurality of tubular cross-supports which extend between the sides of the frame.

The underside of the frame includes a continuous slot. Inserted within the slot is an elastomeric gasket which may take a number of configurations. The elastomeric gasket may be extruded from neoprene and then cut into desired lengths.

The continuous slot extends through the underside of the frame and provides an opening therethrough and has a selected width.

The gasket is both compressible and resilient. The gasket has a lower section which is constructed to rest on the bed or rail of a vibrating shaker. The gasket also includes a reduced portion having a width less than the width of the slot. Finally, the gasket includes an upper portion having a width larger than the width of the slot. Accordingly, the gasket may be press fit so that the upper portion will pass into and through the slot and reside in the hollow portion of the tubular frame. No adhesive or fasteners are required to secure the gasket to the frame.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
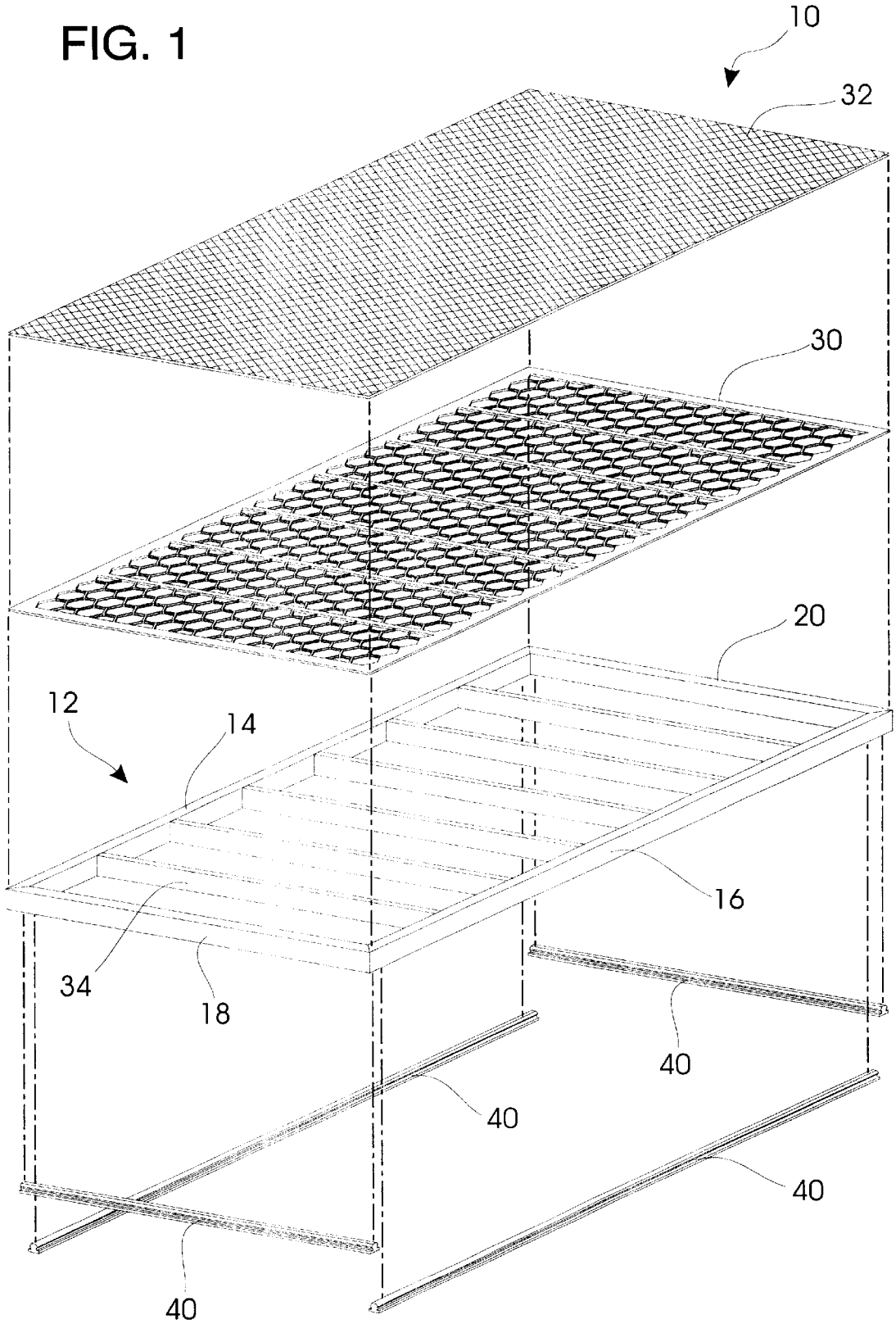
FIG. 1 is an exploded, perspective view of one preferred embodiment of a vibrating screen assembly constructed in accordance with the present invention.

Referring to the drawings in detail, FIG. 1 illustrates an exploded, perspective view of one preferred embodiment of a vibrating screen assembly constructed in accordance with the present invention. A frame 12 includes a pair of parallel, opposed sides 14 and 16 and a pair of opposed, parallel ends 18 and 20. All of the sides and all of the ends may be composed of the same pieces which are extruded and then cut to desired size. In the present preferred embodiment, the tubular sides and ends are composed of extruded aluminum, although it should be understood that other materials, such as composites, might also be used.

Figure 2:
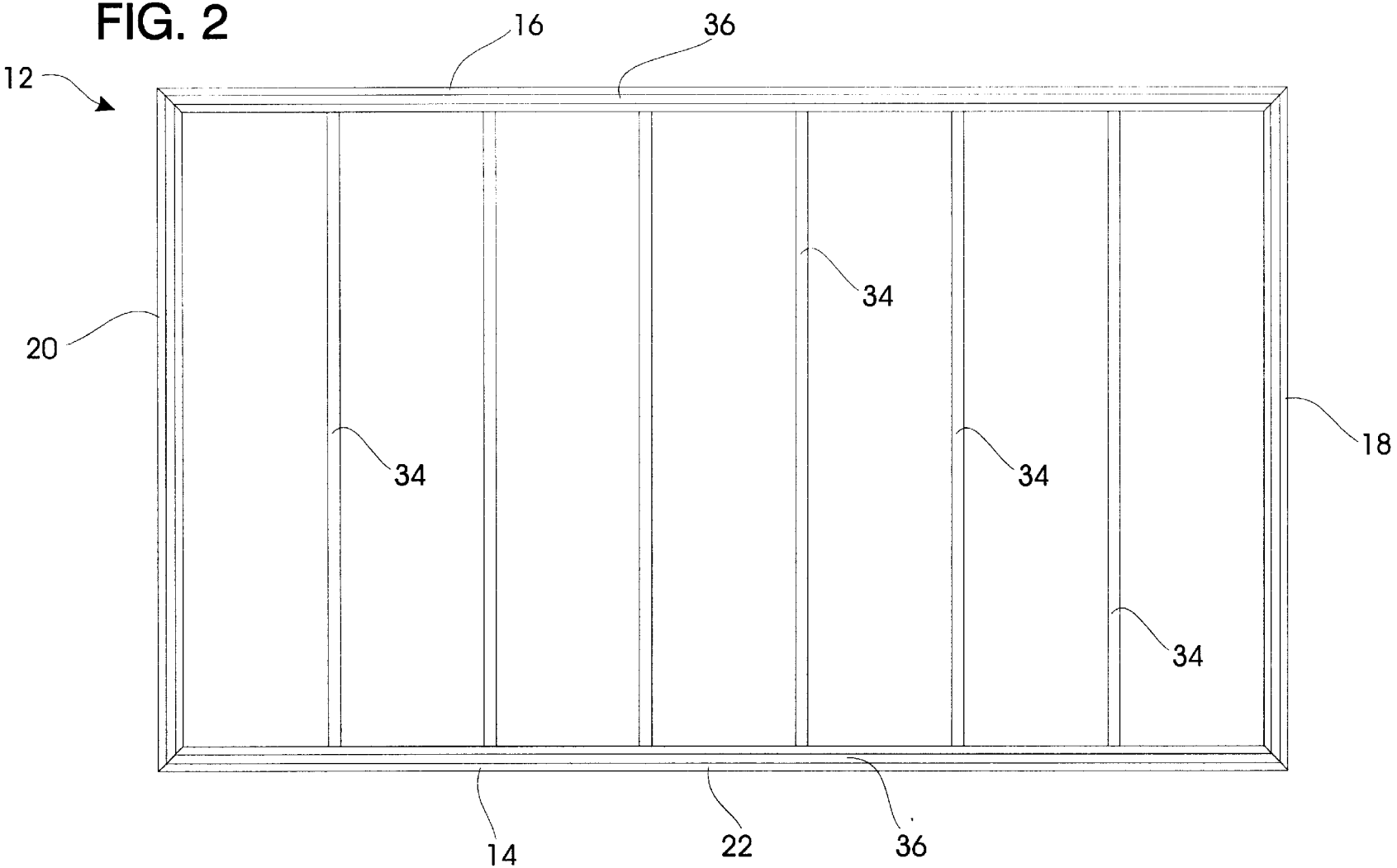
FIG. 2 is a view of an underside of a frame of the screen assembly shown in FIG. 1.

The frame 12 includes an underside 22 shown in FIG. 2. The frame 12 also includes an opposed, top side 24 shown in FIG. 3.

Figure 3:
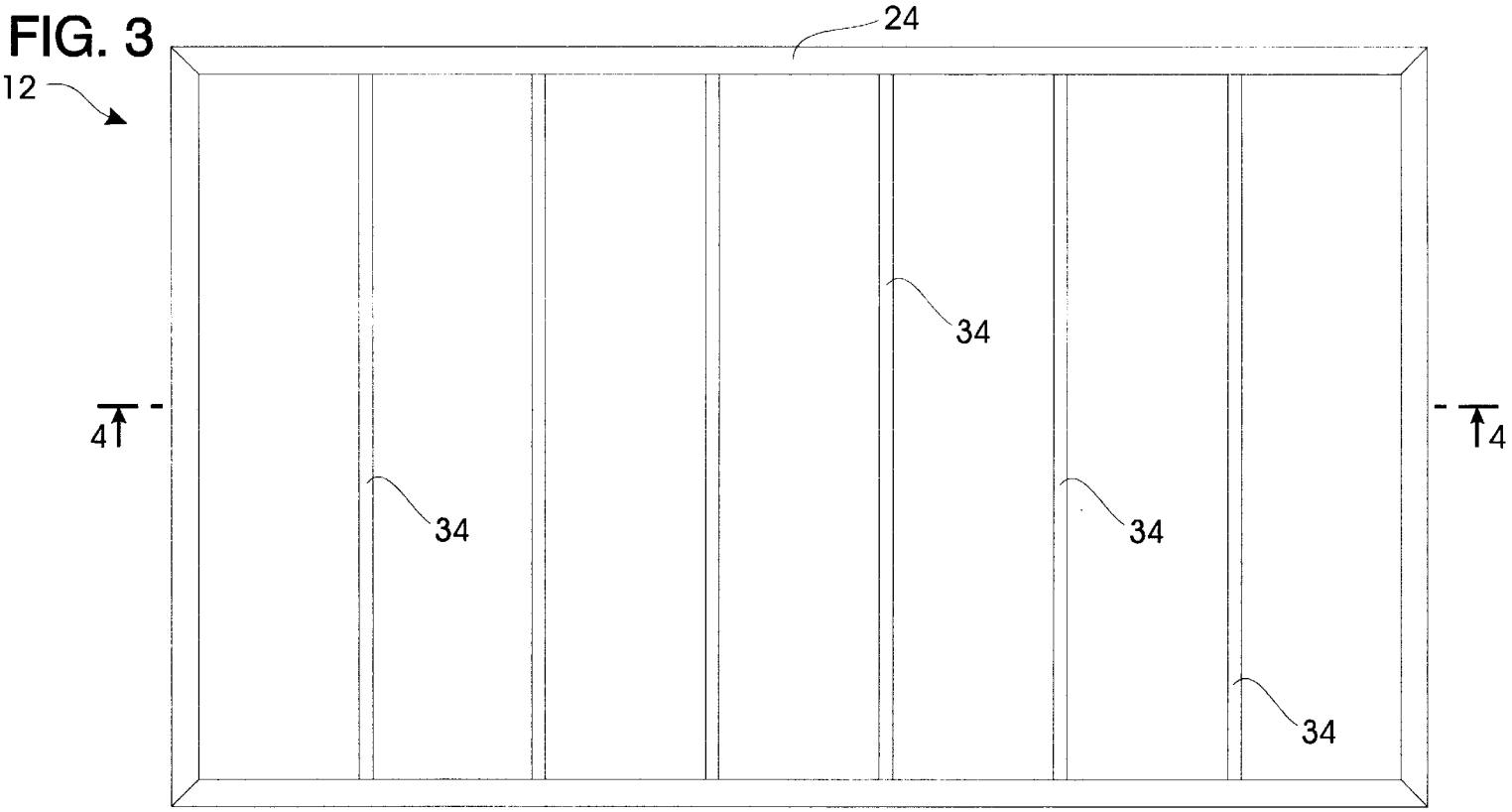
FIG. 3 is a top view of the frame shown in FIG. 2.

Referring back to FIG. 1 and with continuing reference to FIG. 3, the top side 24 of the frame has a flat, planar surface. A perforated plate 30 is attached to and secured to the frame 12 in the assembled condition. The perforated plate 30 includes a plurality of openings which are punched or otherwise formed in the plate 30. The perforated plate 30 may include a border area which will align with the planar surfaces of the top side of the frame, providing an area for good adhesion between the frame and the plate.

At least one screen cloth 32 is secured to the perforated plate. The screen assembly 10 may be made of a single woven wire screen layer or of multiple screen layers.

The frame also includes a plurality of tubular cross supports 34 which extend between the sides 14 and 16. The tubular cross supports may be fabricated from the same or different pieces as the sides and ends.

The underside 22 of the frame includes a continuous slot 36 through each of the sides and ends as best seen in FIG. 2.

Figure 4:
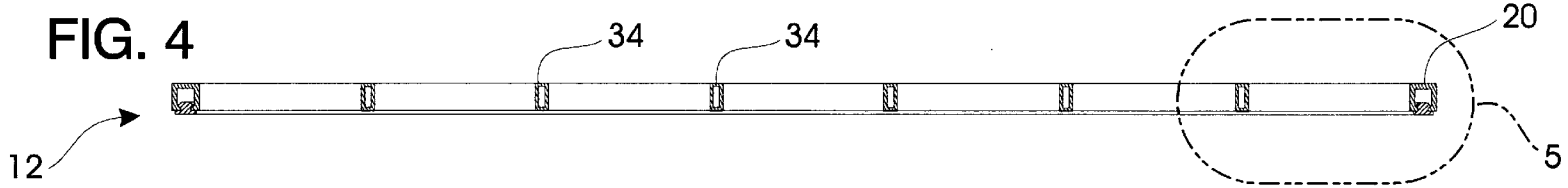
FIG. 4 is a sectional view of a frame with an elastomeric gasket installed therewith.

FIG. 4 illustrates a sectional view of a frame 12 apart from the perforated plate 30. Inserted within the slot 36 is an elastomeric gasket 40 which may take a number of configurations within the teachings of the present invention. The gasket may be extruded from neoprene or other materials and then cut into desired lengths, as best seen in FIG. 1. It may be necessary to miter the ends of the gasket 40 to match the frame or alternatively, the ends of the gaskets can be sealed together.

Figure 5:
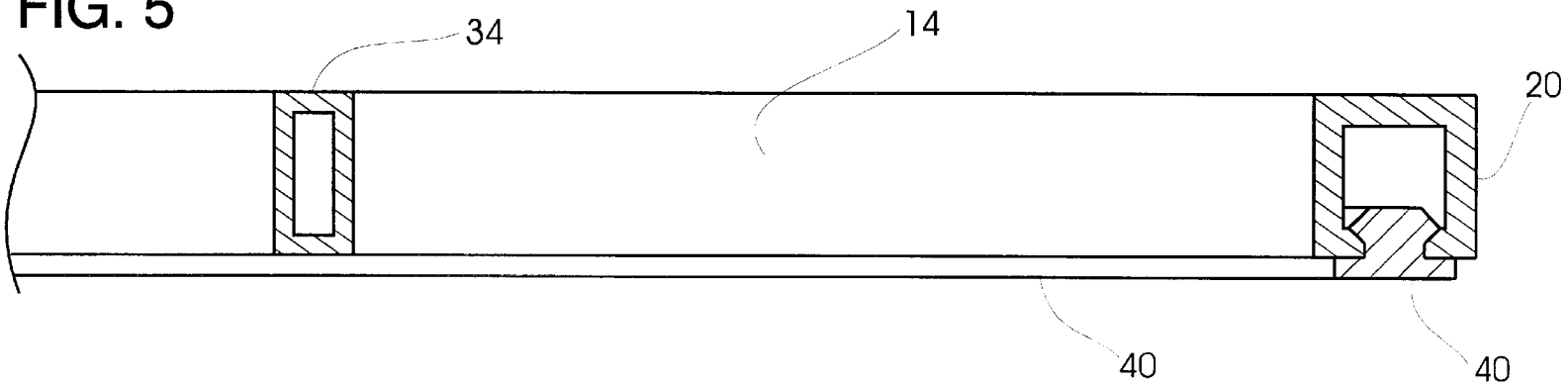
FIG. 5 is an enlarged view of a portion of the frame and gasket shown in FIG. 4.
Figure 6:
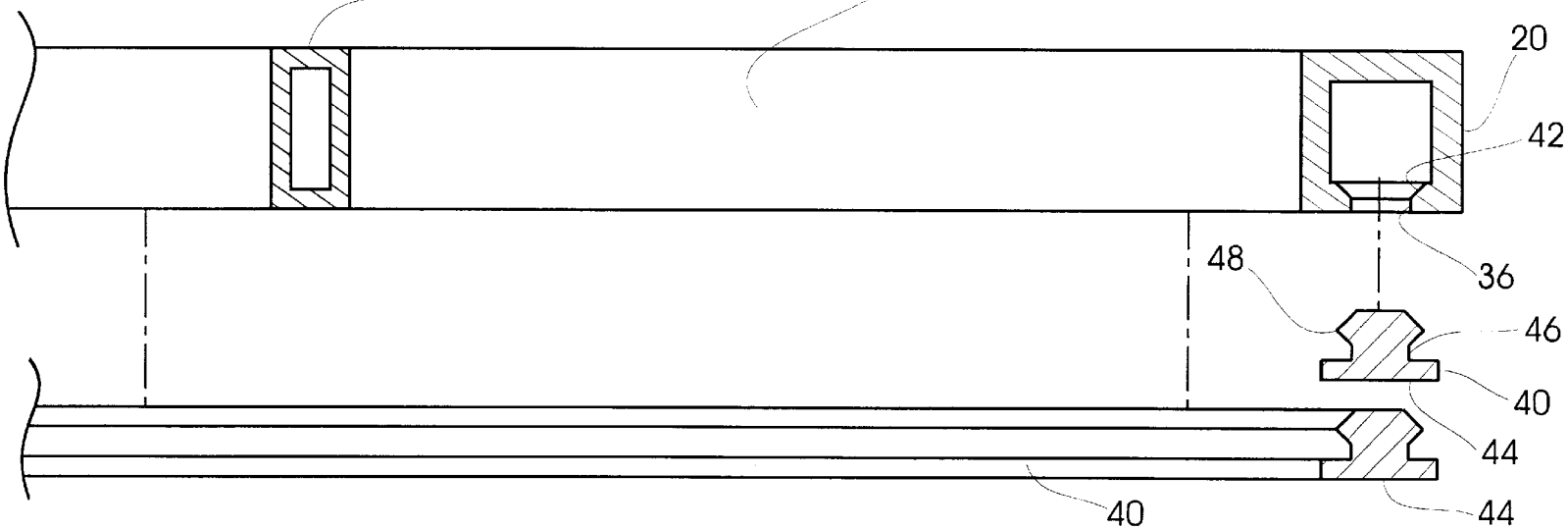
FIG. 6 is an exploded view of the portion of the frame and gasket shown in FIG. 5.

FIGS. 5 and 6 show an enlarged view of a portion of the frame and the gasket 40. FIG. 5 shows the gasket inserted into the frame while FIG. 6 shows the gasket apart from the frame 12.

Referring specifically to FIG. 6, the continuous slot 36 is visible as an opening through the frame 12. The slot 36 has a width and, in one embodiment, the slot 36 has an internal bevel 42.

The elastomeric gasket 40 is both compressible and resilient. The gasket 40 has a lower section 44 which is flat and constructed to rest on the bed or rail of the vibrating shaker (not seen). The gasket 40 also includes a reduced portion 46 having a width slightly less than the width of the slot 36. The gasket also includes an upper portion 48 having a width larger than the width of the slot.

The gasket 40 in a preferred embodiment is composed of neoprene which is not only elastomeric but is also compressible and resilient. Accordingly, the gasket may be press fit so that the upper portion 48 will pass into and through the slot 36 and reside in the hollow portion of the tubular side or end. In the embodiment shown in FIGS. 5 and 6, the slot includes a bevel 42 and the gasket 40 has a corresponding portion to mate with the bevel.

Figure 7:
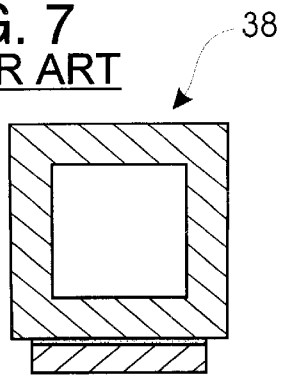
FIG. 7 PRIOR ART
FIG. 7 illustrates a cross-sectional view of a portion of a frame and a gasket found in the prior art.

FIG. 7 illustrates a sectional view of the prior art configuration 38 of a portion of a tubular frame and a gasket in cross-section. The gasket would be adhesively secured to the underside of the frame.

Figure 8:
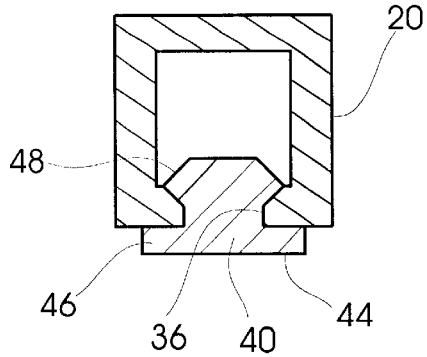
FIGS. 8 through 13 illustrate various configurations of the frame and gasket utilizing the teachings of the present invention.

FIGS. 8 through 12 illustrate various different embodiments incorporating the teachings of the present invention. FIG. 8 shows one preferred embodiment having a slot 36 through the underside 22 of the frame. The gasket 40 includes a lower portion 44 which will rest on the bed of the vibrating shaker. The gasket 40 also includes a reduced portion 46 which has a width slightly less than the opening in the slot. The gasket also includes an upper portion 48 having a width larger than the width of the slot. Accordingly, once the gasket has been press fit into and through the slot, the upper portion 48 will prevent the gasket from being dislodged from the frame.

Figure 9:
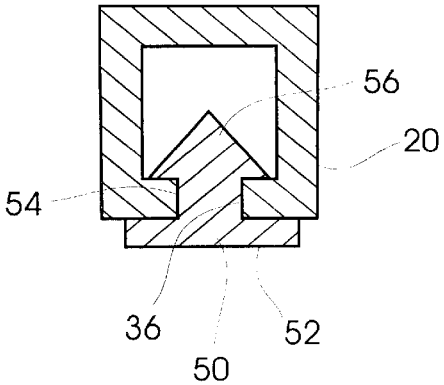

FIG. 9 shows an alternate embodiment of a gasket and frame incorporating the teachings of the present invention. The side or end 20 has a continuous slot 36 therethrough on the underside 22. The gasket 50 includes a lower surface 52 to rest on the vibrating shaker. The gasket 50 also includes a reduced portion 54 having a width less than the width of the slot 36. The gasket 50 also includes an upper portion 56 having a width larger than the width of the slot. In cross-section, the upper portion of the gasket is triangular in shape.

Figure 10:
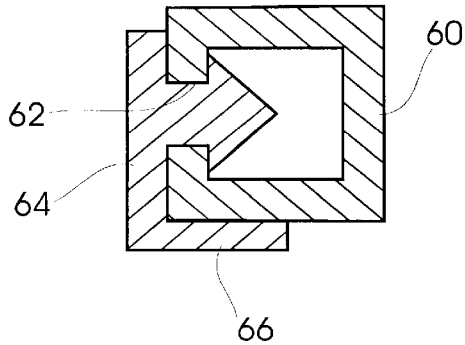

FIG. 10 illustrates a further alternate embodiment incorporating the teachings of the present invention. A frame end or side 60 has a slot 62 through one of the sidewalls. A gasket 64 is similar in configuration to the gasket shown in FIG. 9 with a lip 66 which covers at least a portion of the underside of the tubular side or end 60.

Figure 11:
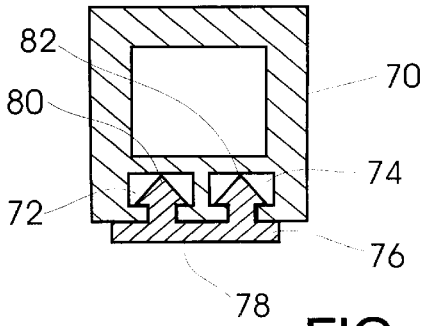

FIG. 11 illustrates a further alternate embodiment of the present invention. A tubular side or end 70 includes a pair of openings 72 and 74 which do not penetrate the wall of the tube 70. A gasket 76 includes a lower surface 78 which rests on the vibrating shaker. The gasket 76 also includes a pair of upper portions 80 and 82 which reside in the openings.

Figure 12:
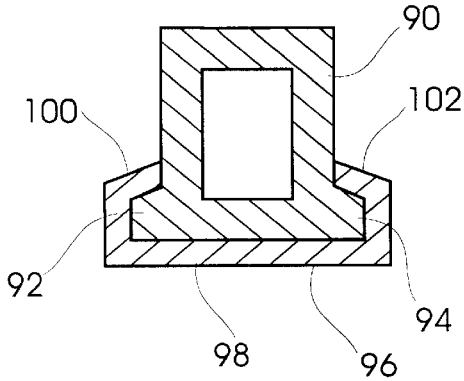

FIG. 12 illustrates a further alternate embodiment of the present invention. A frame side or end 90 includes a pair of protrusions 92 and 94. A gasket 96 includes a lower surface 98 which rests on the vibrating shaker and a pair of lips 100 and 102 which surrounds the protrusions and forms a cap thereover.

Figure 13:
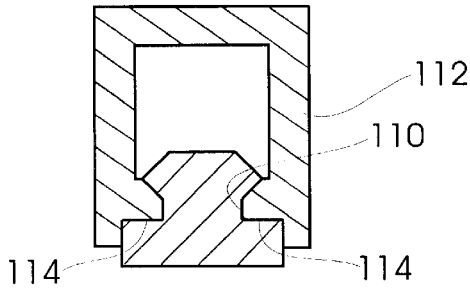

Finally, FIG. 13 illustrates a further alternate embodiment of the present invention having a slot 110 through the underside of the tubular frame 112. The slot 112 includes a recessed shoulder 114 to receive gasket 116.

It will be understood that the configuration of the gasket and frame is not limited to the foregoing. The various embodiments share the common attribute that the gasket in each case is mechanically locked to the frame without use of any fasteners or adhesives.

The process for producing a vibrating screen assembly 10 in accordance with the present invention includes a number of steps. Initially, the sides 14 and 16 and the ends 18 and 20 of the frame 12 are extruded into lengths from aluminum. These frame sections are then cut to desired lengths to form a pair of opposed sides and a pair of opposed ends. The sides and ends are cut at 45° angles so that they will mate together to form an exterior frame.

Lengths of tubular cross-supports 34 are also cut from extruded aluminum. The opposed sides and the opposed ends are clamped together and then tack welded. The entire frame 12 including the cross supports is then welded together. The connecting weld points may require some minor surface grinding to achieve a smooth finish.

The gasket 40 may be applied either before or after securing the perforated plate and screen cloths. In one procedure, the perforated plate 30 is fabricated with openings and thereafter coated with epoxy. Both heat and pressure are used to bond the screen mesh cloth 32 or layers to the perforated plate thereby securing the perforated plate and the screen cloth together.

The perforated plate and the accompanying screen cloth are thereafter secured to the frame 12. A bead of glue or other adhesive is placed on the frame so that a secure bond is formed.

The frame will then be turned so that the lower side is facing up. The gasket 40 which has been formed as a continuous piece will then be cut to the desired lengths. The gasket may be cut at 45° angles so that the individual pieces will mate together. A sealant may be applied to the mitered ends of the gasket 40 to assure a fluid tight seal where the gasket pieces meet together.

By use of the present invention, no adhesives or fasteners are required to secure the gasket to the frame 12.

Whereas, the present invention has been described in relation to the drawings attached hereto, it should be understood that other and further modifications, apart from those shown or suggested herein, may be made within the spirit and scope of this invention.

What is claimed is:

1. A screen assembly for a vibrating shaker, which comprises:

a tubular frame having a top side and an underside;

at least one screen cloth affixed to said top side of said frame;

a slot in said tubular frame, said slot having a width; and an elastomeric gasket having at least a portion wider than said width of said slot so that said gasket may be press fit into said slot and held therein.

2. A screen assembly for a vibrating shaker as set forth in claim 1 wherein said tubular frame includes a pair of parallel, opposed tubular sides and a pair of parallel, opposed tubular ends mitered together.

3. A screen assembly for a vibrating shaker as set forth in claim 2 wherein said sides and said ends are extruded and cut in lengths to form said sides and said ends.

4. A screen assembly for a vibrating shaker as set forth in claim 3 wherein said tubular sides and said tubular ends are fabricated from aluminum.

5. A screen assembly for a vibrating shaker as set forth in claim 2 wherein said frame includes a plurality of tubular cross supports extending between said tubular sides.

6. A screen assembly for a vibrating shaker as set forth in claim 1 including a perforated plate adhesively secured to said top side of said frame and a plurality of said screen cloths affixed to said perforated plate.

7. A screen assembly for a vibrating shaker as set forth in claim 1 wherein said at least one screen cloth is tensioned prior to being affixed to said top side of said tubular frame.

8. A screen assembly for a vibrating shaker as set forth in claim 1 wherein said slot is in said under side of said tubular frame and forms a continuous channel in said frame.

9. A screen assembly for a vibrating shaker as set forth in claim 1 wherein said elastomeric gasket is compressible and resilient.

10. A screen assembly for a vibrating shaker as set forth in claim 1 wherein said elastomeric gasket is neoprene.

11. A screen assembly for a vibrating shaker as set forth in claim 1 wherein said elastomeric gasket is extruded and cut in lengths.

12. A screen assembly for a vibrating shaker as set forth in claim 1 wherein said elastomeric gasket has a lower surface to rest on said vibrating shaker, a reduced portion having a width less than said width of said slot, and an upper portion having a width larger than said width of said slot.

13. A screen assembly for a vibrating shaker as set forth in claim 1 wherein said slot is beveled and said gasket mates with said slot.

14. A screen assembly for a vibrating shaker as set forth in claim 1 wherein said slot extends through said underside of said tubular frame.

15. A screen assembly for a vibrating shaker as set forth in claim 1 wherein said slot extends through a sidewall of said tubular frame.

16. A screen assembly for a vibrating shaker as set forth in claim 1 including a plurality of said slots in said lower side of said tubular frame.

17. A screen assembly for a vibrating shaker which comprises:

a tubular frame having a top side and an underside;

at least one screen cloth affixed to said top side of said frame;

a pair of opposed projections extending from said tubular frame; and an elastomeric gasket surrounding said pair of opposed projections and said underside of said tubular frame to secure said gasket to said frame.

18. A screen assembly for a vibrating shaker as set forth in claim 17 wherein said elastomeric gasket is neoprene.

19. A screen assembly for a vibrating shaker, which comprises:

a tubular frame having a top side and an underside;

at least one screen cloth affixed to said top side of said frame;

a slot in said tubular frame;

an elastomeric gasket; and means for mechanically locking said gasket in said slot without adhesive or separate fasteners.

20. A screen assembly as set forth in claim 19 wherein said elastomeric gasket has at least a portion wider than said width of said slot.

21. A method for preparing a screen assembly for a vibrating shaker, which method comprises:

preparing a tubular frame with a slot in said frame;

affixing at least one screen cloth to said frame; and press fitting an elastomeric gasket into said slot in said frame so that the gasket will be held therein.

* * * * *